United States Patent [19]

Borders

[11] 4,365,922

[45] Dec. 28, 1982

[54] SIDE-LOADING DUMP UNIT

[75] Inventor: Ernest D. Borders, Statesville, N.C.

[73] Assignee: Rubbermaid Applied Products Inc., Statesville, N.C.

[21] Appl. No.: 260,104

[22] Filed: May 4, 1981

[51] Int. Cl.[3] ..... B65F 3/02

[52] U.S. Cl. ..... 414/406; 414/420; 414/421

[58] Field of Search ..... 414/403, 406, 408, 420, 414/421, 422, 425

[56] References Cited

U.S. PATENT DOCUMENTS 3,804,277 4/1974 Brown et al. ..... 414/421 X 3,894,642 7/1975 Shive ..... 414/421 X

*Primary Examiner*—Robert G. Sheridan

*Attorney, Agent, or Firm*—Hamilton, Renner & Kenner

[57] ABSTRACT

A receptacle dumping mechanism having a frame (29,37,38) mounted on the drive shaft (26) of a rotary actuator (24) mounted on the side of a collector vehicle (18), a face plate (34) pivoted to the lower end of said frame and adapted to engage a shoulder (17) on receptacle (10) to lift the receptacle as the frame is rotated, link means (40) interconnecting said face plate with the mounting plate (25 or 27) for the actuator, at a point (40') eccentric of the drive shaft (26), hook levers (53) pivoted on the face plate (34) adapted to engage an abutment (52) on the receptacle (10) to lock it in inverted position, and bell crank links (56) operatively connecting the hook levers (53) to a cross bar (38) on the frame.

12 Claims, 5 Drawing Figures

SIDE-LOADING DUMP UNIT

TECHNICAL FIELD

The invention relates to dumping mechanisms for lifting mobile waste receptacles brought to the side of a collection vehicle and dumping the contents of the receptacle into the vehicle.

BACKGROUND ART

Certain prior devices for dumping mobile waste receptacles into curb-side trucks have been adapted to lift the receptacles and dump their contents into the truck. Prior U.S. Pat. Nos. 3,804,277 and 3,894,642 exemplify such devices.

A difficulty experienced with these and other similar devices is that the waste material was dumped too close to the outer wall of the truck hopper and tended to pile up and even spill over into the street. Moreover, due to the uneven distribution of the waste material, when it was dumped from the truck into a compacter it was not compacted satisfactorily.

DISCLOSURE OF INVENTION

The present improved mechanism overcomes the foregoing difficulties and provides for dumping the contents of a receptacle into substantially the central portion of the vehicle hopper.

It is an object of the invention to provide an improved lifting and dumping mechanism which is adapted to lift and rotate the receptacle to an inverted dumping position for delivering the waste material into the central portion of the vehicle hopper.

Another object is to provide improved lifting and dumping mechanism which is simple and inexpensive to construct.

Another object is to provide improved positively moving, lifting and dumping mechanism.

A further object is to provide improved locking mechanism automatically operated by the lifting mechanism to lock the receptacle in its inverted dumping position.

A still further object is to provide improved lifting mechanism which automatically swings the receptacle to its proper dumping position relative to the vehicle hopper as the receptacle is lifted.

These and other objects are accomplished by the improvements comprising the present invention, a preferred embodiment of which is disclosed herein by way of example, as exemplifying the best known mode of carrying out the invention. Various modifications and changes in details of construction are comprehended within the scope of the appended claims.

PREFERRED EMBODIMENT OF THE INVENTION

Figure 1:
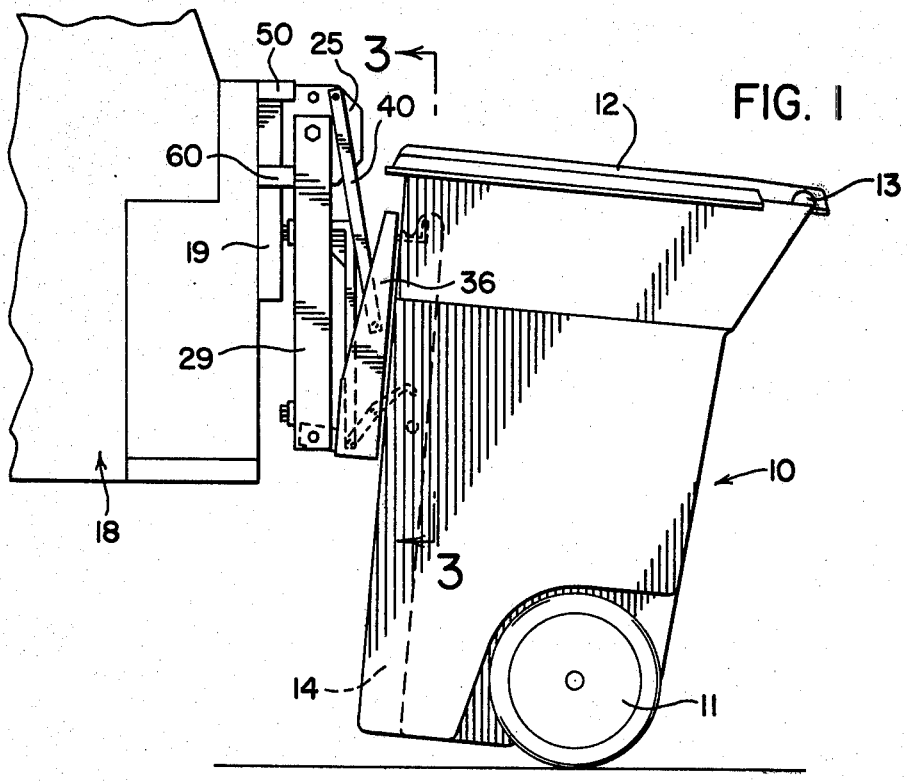
FIG. 1 is a side elevation showing a receptacle at the side of a waste collection vehicle in position to be lifted by the improved lifting mechanism.

The improved lifting and dumping mechanism is adapted to be used with a mobile waste receptacle such as indicated generally at 10, rollably supported on wheels 11, having a top cover 12 hinged at 13 to the rear upper edge of the receptacle. The front wall of the receptacle has a recess 14 defined by vertical recessed wall 15 preferably extending upwardly from the bottom of the receptacle and terminating in an overhanging recessed wall portion 16 forming a shoulder 17 near the top of the receptacle, which is engaged by the lifting mechanism to lift the receptacle.

The lifting mechanism is mounted on the side of a waste collection vehicle or pick-up truck indicated generally at 18 and the mounting means comprises vertical angles 19 and top and bottom transverse angles 20 and 21, respectively, secured to the side of the truck. An intermediate transverse angle 22 spaced below angle 20 is secured at its ends to the vertical angles 19.

A rotary motor or actuator 24 of known construction is mounted on the angles 20 and 22 by means of a mounting plate 25 bolted to the actuator housing. The plate extends outwardly from the frame and has its inner edge secured as by welding to the transverse angles 20 and 22. The shaft 26 of the actuator extends laterally from both sides of the actuator housing, and on the side opposite plate 25 the shaft is rotatably supported in a support plate 27 having its inner edge secured as by welding to the transverse angles 20 and 22.

The opposite ends of actuator shaft 26 are nonrotatively secured in sockets 28 welded in the upper ends of depending channels 29. Screws 30 secure the end faces of the shaft to the webs 31 of the channels. The lower ends of channels 29 are pivotally connected by pins 32 to the ends of bars 33 having their outer ends in abutment with a face plate 34 and secured as by welding to the bottom and side flanges 35 and 36 thereof, respectively. Preferably, the channels are interconnected near their lower ends by a cross bar 37 and are interconnected at intermediate points by a cross bar 38, forming a rectangular frame.

Push links 40 and 41 on opposite sides of the actuator 24 are pivoted at their lower ends to brackets 42 attached to medial portions of the face plate. The upper end of push link 40 is pivoted eccentrically of shaft 26 at 40' to mounting plate 25, and the upper end of push link 41 is similarly pivoted at 41' to support plate 27.

Near the upper edge of the face plate an upturned transverse angle 44 is secured to its outer surface to form with the face plate a saddle adapted to engage under the shoulder 17 and extend into the space under the overhanging wall 16. The angle 44 is preferably supported on a transverse angle 45 backed by a reinforcing bar 46 on the inner surface of the face plate, the angle 45 and bar 46 being secured to the face plate by bolts 47.

Figure 2:
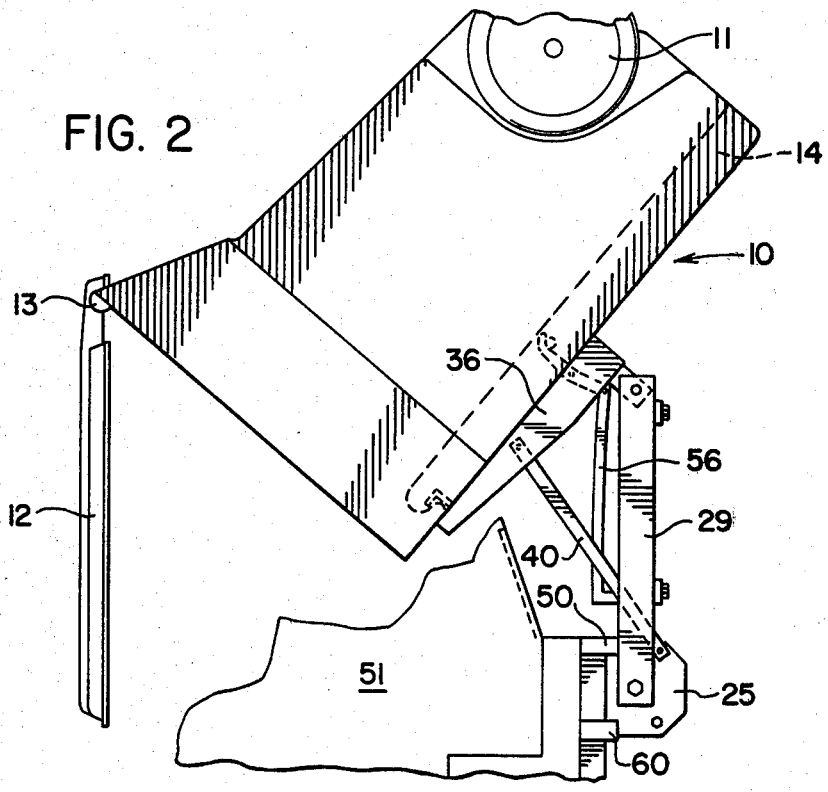
FIG. 2 is a similar view showing the receptacle in fully lifted and dumping position.
Figure 3:
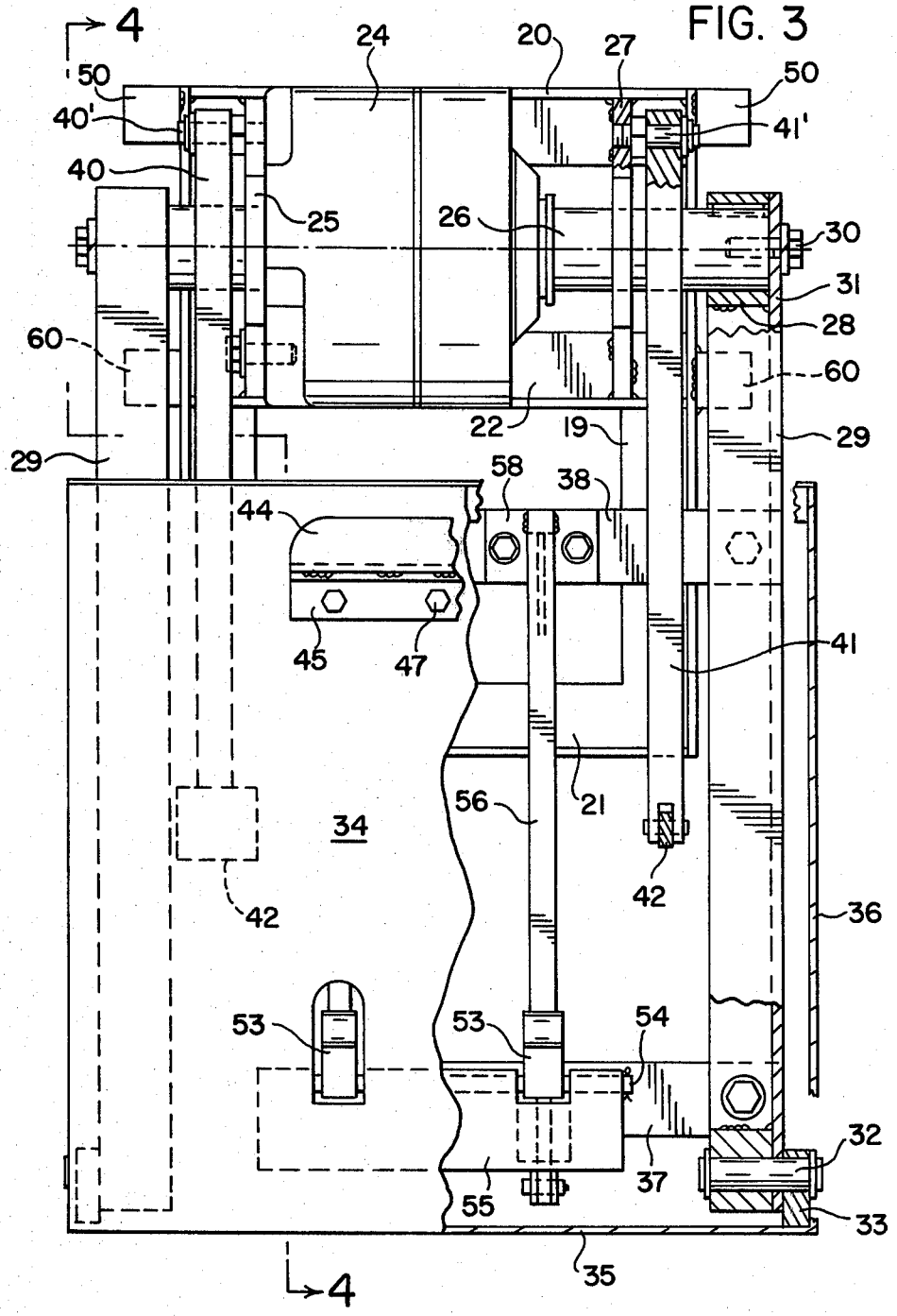
FIG. 3 is an enlarged front elevation, partly in section, as on line 3—3 of FIG. 1.
Figure 4:
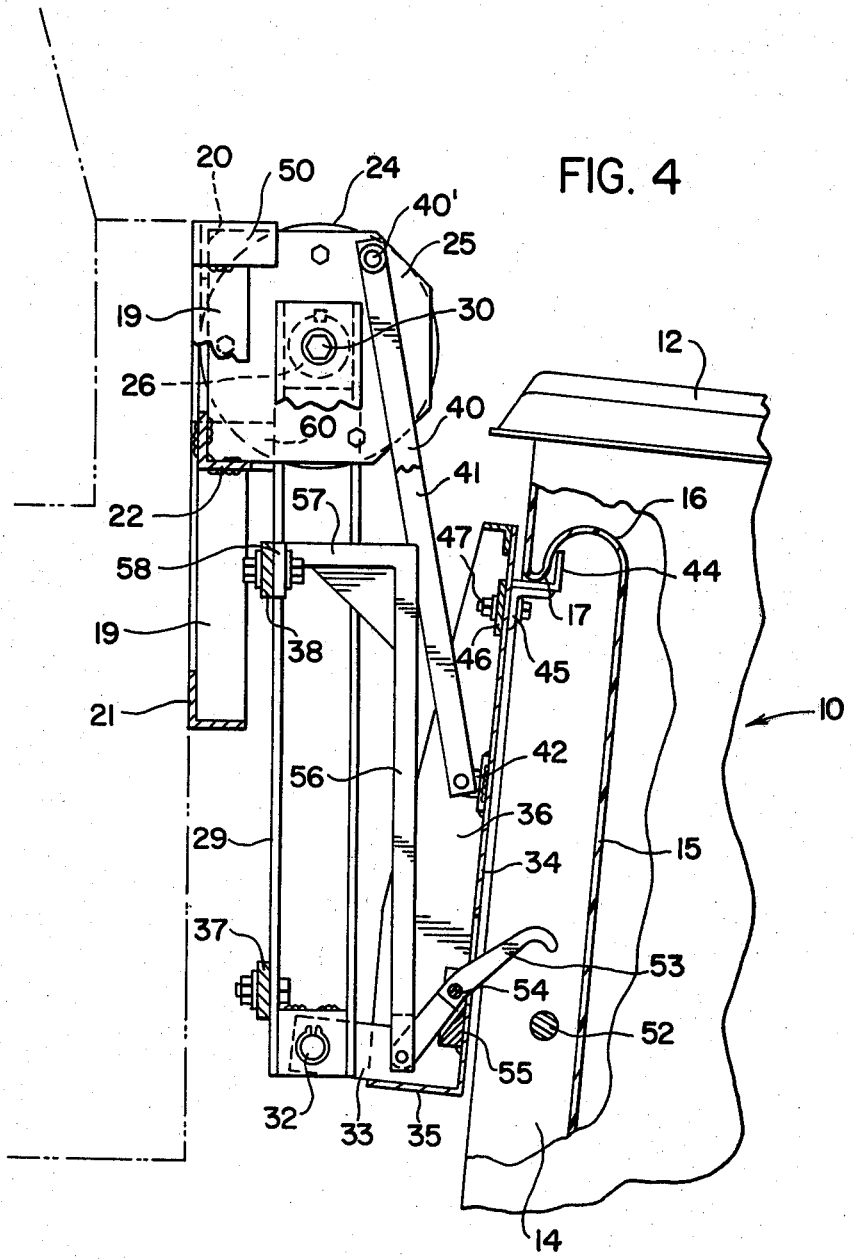
FIG. 4 is an enlarged fragmentary side elevation on line 4—4 of FIG. 3.
Figure 5:
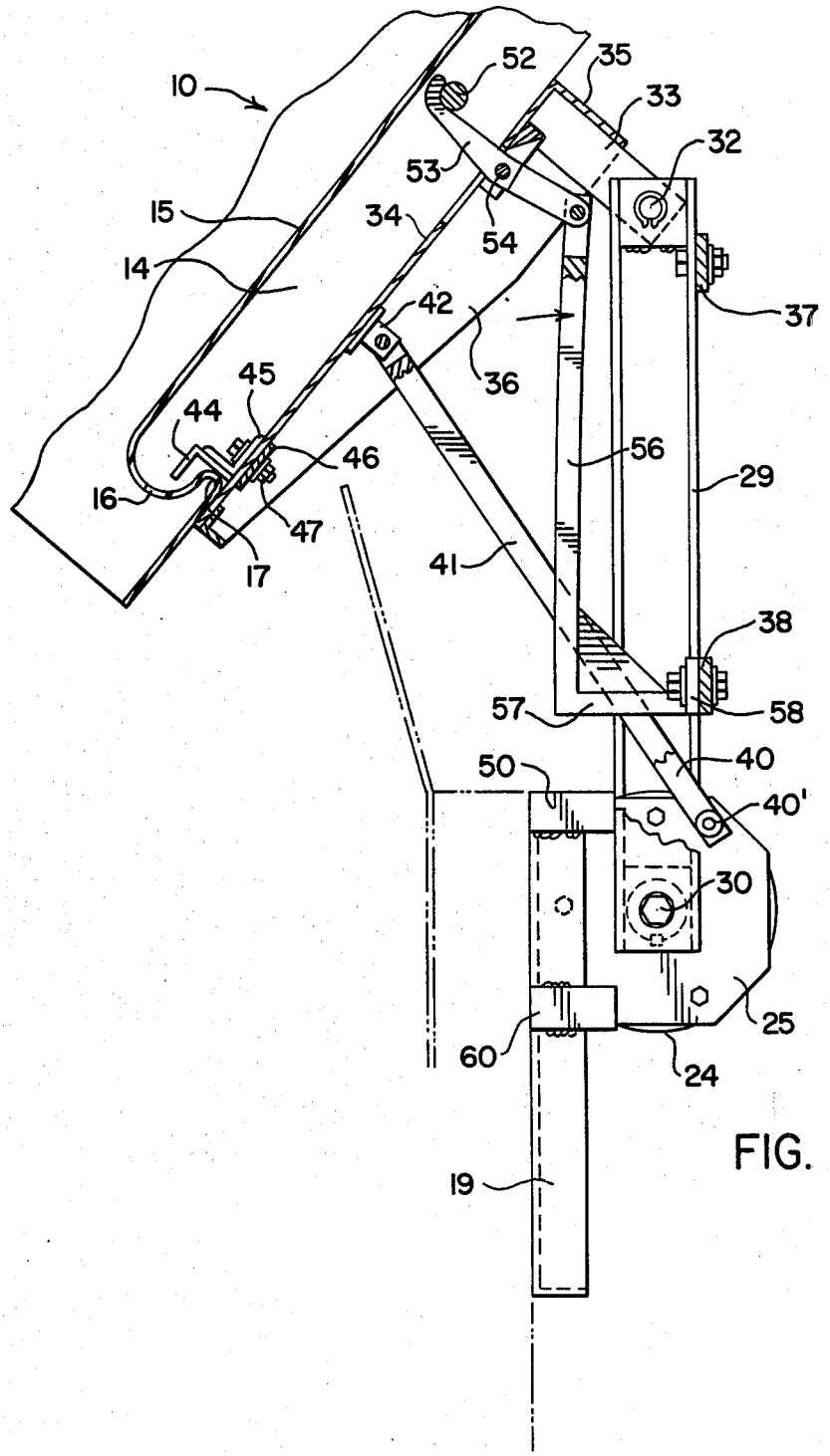
FIG. 5 is a similar view showing the receptacle in fully lifted and dumping position.

Rotation of the actuator shaft 26 to rotate the channels 29 in a counterclockwise direction, as viewed in FIGS. 2 and 5, will rotate the face plate 34 and lift and invert a receptacle 10 supported thereon. The channels 29 are arranged to rotate through 180° as indicated by comparison of FIGS. 4 and 5, and stop blocks 50 are secured to the ends of transverse angle 20 to limit the upward rotation of the channels 29. As the channels 29 and face plate 34 rotate upwardly, the push links 40 and 41, due to the eccentricity of their pivots 40' and 41' relative to shaft 26, will push the face plate away from the channels 29, resulting in moving the open end of the receptacle inwardly away from the outer edge of the receiving hopper 51 so as to discharge the waste material from the receptacle toward the center portion of the vehicle hopper.

In order to prevent the receptacle in its inverted position from sliding downwardly off the face plate a transverse abutment bar 52 is provided in the receptacle recess 14 spaced from the overhanging wall 16, and hook means 53 are pivoted on the face plate to engage the bar 52 and hold the receptacle in inverted position. The hook means are preferably levers pivoted at 54 to a bracket plate 55 secured on the face plate.

A linkage is provided to move the hook levers under the bar 52 as the channels 29 rotate upwardly and the links 40 gradually push the face plate away from the channels. This linkage comprises bell crank links 56 pivoted at their lower ends to the inner ends of hook levers 53 with their upper right-angled end portions 57 secured by brackets 58 to the transverse bar 38. Accordingly, as the face plate swings outwardly away from channels 29 to the position of FIG. 5, the hook levers 53 are rotated to the position shown in FIG. 5 with the hooks under the bar 52. The slight arcuate movement of the inner pivoted ends of hook levers 53 about their pivots 54 is absorbed by the resiliency of bell crank links 56.

When the waste material has been dumped into the hopper of the truck, the actuator is energized to rotate the channels 29 clockwise and return them 180° to the position of FIG. 4 for removal of the empty receptacle 10. Stop blocks 60 are provided on the ends of transverse frame angle 22 to limit rotation of the channels in this direction.

It will be apparent that an improved receptacle lifting and dumping mechanism has been provided for dumping waste material into the central portion of the collection vehicle on which the mechanism is mounted, with improved means automatically locking the receptacle in dumping position.

I claim:

1. Receptacle dumping mechanism for lifting and inverting a receptacle, comprising a frame rotatably mounted on the side of a waste collector, a face plate pivoted on the bottom of said frame and having a saddle at its upper end, means to rotate said frame to lift and invert a receptacle supported on said saddle, and a push link pivotally connected at one end to the waste collector and at the other end to the face plate for swinging the upper end of the face plate away from the frame as the frame is rotated to lift and invert a receptacle supported on said saddle.

2. Receptacle dumping mechanism as described in claim 1, wherein the means to rotate the frame is supported on the waste collector by a mounting plate and said one end of the push link is pivoted to said mounting plate.

3. Receptacle dumping mechanism as described in claim 2, wherein a hook lever is pivoted on said face plate and adapted to engage an abutment on said receptacle to hold it in inverted dumping position over the waste collector.

4. Receptacle dumping mechanism as described in claim 3, wherein link means connecting said hook lever to said frame moves the hook lever into engagement with said abutment as the frame is rotated upwardly to lift and invert the receptacle.

5. Receptacle dumping mechanism as described in claim 4, wherein said link means is a bell crank secured at one end to the frame and pivoted at its other end to said hook lever.

6. Receptacle dumping mechanism as described in claim 1, wherein a hook lever is pivoted on said face plate and sdapted to engage an abutment on said receptacle to hold it in inverted dumping position over the waste collector.

7. Receptacle dumping mechanism as described in claim 6, wherein link means connecting said hook lever to said frame moves the hook lever into engagement with said abutment as the frame is rotated upwardly to lift and invert the receptacle.

8. Receptacle dumping mechanism as described in claim 7, wherein said link means is a bell crank secured at one end to the frame and pivoted at its other end to said hook lever.

9. Receptacle dumping mechanism for lifting and inverting a receptacle, comprising a rotary actuator supported on a mounting member on the side of a waste collector and having a drive shaft, a frame mounted at its upper end on said shaft, a face plate pivoted on the bottom of said frame and having a saddle on its upper end for lifting and inverting a receptacle supported thereon as the frame is rotated by said actuator, and a push link pivotally connected at one end to said mounting member eccentrically of said shaft and at the other end to said face plate for swinging the upper end of said face plate away from said frame as the frame is rotated to lift and invert the receptacle.

10. Receptacle dumping mechanism as described in claim 9, wherein a hook lever is pivoted on said face plate and adapted to engage an abutment on said receptacle to hold it in inverted dumping position over the waste collector.

11. Receptacle dumping mechanism as described in claim 10, wherein link means connecting said hook lever to said frame moves the hook lever into engagement with said abutment as the frame is rotated upwardly to lift and invert the receptacle.

12. Receptacle dumping mechanism as described in claim 11, wherein said link means is a bell crank secured at one end to the frame and pivoted at its other end to said hook lever.

* * * * *